US007840171B2

(12) United States Patent
Kim et al.

(10) Patent No.: US 7,840,171 B2
(45) Date of Patent: Nov. 23, 2010

(54) DEVELOPING UNIT HAVING SUPPORT UNITS TO MINIMIZE DEFORMATION FROM HEAT AND PRESSURE, AND IMAGE FORMING APPARATUS HAVING THE SAME

(75) Inventors: Jong-in Kim, Suwon-si (KR); Myoung-su Baek, Suwon-si (KR); Soon-seok Kwon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 463 days.

(21) Appl. No.: 11/874,423

(22) Filed: Oct. 18, 2007

(65) Prior Publication Data

US 2008/0240814 A1 Oct. 2, 2008

(30) Foreign Application Priority Data

Mar. 27, 2007 (KR) ..... 10-2007-0029973

(51) Int. Cl.
*G03G 21/00* (2006.01)
*G03G 21/16* (2006.01)

(52) U.S. Cl. ..... 399/358; 399/111

(58) Field of Classification Search ..... 399/35, 399/111, 113, 120, 123, 358, 360
See application file for complete search history.

(56) References Cited

U.S. PATENT DOCUMENTS 5,184,184 A 2/1993 Hayashi et al.
5,852,762 A 12/1998 Hatta et al.
7,024,134 B2 * 4/2006 Yokomori et al. ..... 399/111
7,245,867 B2 * 7/2007 Baek et al. ..... 399/358
7,266,338 B2 * 9/2007 Baek ..... 399/350
7,321,740 B2 * 1/2008 Choi et al. ..... 399/113

(Continued)

FOREIGN PATENT DOCUMENTS

EP 0 476 717 3/1992

(Continued)

OTHER PUBLICATIONS

Korean Office Action issued Mar. 2, 2009 in KR Application No. 2007-0029973.

(Continued)

*Primary Examiner*—Robert Beatty
(74) *Attorney, Agent, or Firm*—Stanzione & Kim, LLP

(57) ABSTRACT

A developing unit includes a waste toner housing having an upper housing and a lower housing which face each other, at least one support unit to allow connection between the upper and lower housings, and to support facing surfaces of the upper and lower housings, and a toner housing which is disposed on a lower part of the waste toner housing and is spaced apart from the waste toner housing at a predetermined distance. Accordingly, the waste toner housing is prevented from being deformed by heat and pressure, and thus white lines on images, flowback of waste toner and insufficient cleaning, which are caused by interference with the light path due to deformation of the waste toner housing, can be reduced. Additionally, tolerance can be greatly reduced as a result of resolving the problem of deformation of the waste toner housing, so a developing unit having a smaller size can be provided.

20 Claims, 6 Drawing Sheets

U.S. PATENT DOCUMENTS

| | | | | |
|---|---|---|---|---|
| 7,406,290 | B2 * | 7/2008 | Choi et al. | 399/350 |
| 7,415,237 | B2 * | 8/2008 | Okoshi | 399/350 |
| 7,646,995 | B2 * | 1/2010 | Kim et al. | 399/35 |
| 2007/0041761 | A1 * | 2/2007 | Kim | 399/351 |
| 2008/0240811 | A1 * | 10/2008 | Park et al. | 399/350 |

FOREIGN PATENT DOCUMENTS

| | | | |
|---|---|---|---|
| EP | 0 827 049 | | 3/1998 |
| JP | 10-153932 | | 6/1998 |
| JP | 2005077614 | A * | 3/2005 |
| JP | 2005227318 | A * | 8/2005 |
| JP | 2006053295 | | 2/2006 |
| KR | 1998-015271 | | 6/1998 |

OTHER PUBLICATIONS

European Search Report dated Jul. 25, 2008 issued in EP 08152593.3.

* cited by examiner

DEVELOPING UNIT HAVING SUPPORT UNITS TO MINIMIZE DEFORMATION FROM HEAT AND PRESSURE, AND IMAGE FORMING APPARATUS HAVING THE SAME

CROSS-REFERENCE TO RELATED APPLICATIONS

This application claims priority under 35 U.S.C. §119 (a) of Korean Patent Application No. 10-2007-0029973, filed on Mar. 27, 2007, in the Korean Intellectual Property Office, the disclosure of which is incorporated herein by reference in its entirety.

BACKGROUND OF THE INVENTION

1. Field of the Invention

The present general inventive concept relates to a developing unit and an image forming apparatus having the developing unit.

2. Description of the Related Art

FIG. 1 is a view illustrating an example of a developing unit mounted in an image forming apparatus.

In FIG. 1, the developing unit includes a toner housing 2, a waste toner housing 6, and a photosensitive medium 5.

Toner is housed in the toner housing 2, and the toner is supplied to an electrostatic latent image on the photosensitive medium 5 by a supplying roller 3 and a developing roller 4.

The toner supplied to the electrostatic latent image is transferred onto a sheet of paper by a transferring unit, and waste toner that is not transferred onto the sheet of paper is removed by a cleaning member 7 mounted on the waste toner housing 6 and collected in the waste toner housing 6.

The toner housing 2 and waste toner housing 6 may be disposed at various positions. In order to reduce the volume of the developing unit, the toner housing 2 and waste toner housing 6 may be disposed respectively above and below a laser beam L of a laser scanning unit (not illustrated) when there is space between the toner housing 2 and waste toner housing 6 so that the laser beam L can pass, as illustrated in FIG. 1.

The interior of the waste toner housing 6 may be empty prior to accommodating waste toner, and wall surfaces of all areas except for an area on which the cleaning member 7 is mounted may be thermally bonded to each other.

However, an upper side of the waste toner housing 6 is formed in a thin plate shape, so vertical flow may occur. Such deformation of the waste toner housing 6 may frequently occur when distributing products or attaching and detaching the developing unit. If an upper surface of the waste toner housing 6 is deformed, the internal air pressure of the waste toner housing 6 may change and the housed waste toner may flow back out of the waste toner housing 6.

When the upper surface of the waste toner housing 6 is deformed, the positions of the cleaning member 7 and various film components for sealing which are mounted inside may be changed, which may cause the waste toner to undesirably flow back due to an air leak or insufficient cleaning.

Additionally, if the upper surface of the waste toner housing 6 is deformed by the heat inside the image forming apparatus, interference between a neighboring developing unit having a different color disposed on the upper side may occur in the case of a color image forming apparatus. It may be hard to attach or detach the developing unit due to interference between inner mounting components in the case of a monocolor image forming apparatus. These problems may be partially addressed by providing sufficient space between the toner housing 2 and the waste toner housing 6, but this undesirably increases the volume of the developing unit.

SUMMARY OF THE INVENTION

The present general inventive concept provides a developing unit which has an improved structure to prevent deformation caused by heat and pressure, and an image forming apparatus having the developing unit.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a developing unit including a waste toner housing including an upper housing and a lower housing which face each other; at least one support unit to allow connection between the upper and lower housings, and to support facing surfaces of the upper and lower housings; and a toner housing which is disposed on a lower part of the waste toner housing and is spaced apart from the waste toner housing at a predetermined distance.

The at least one support unit may include a plurality of support projections and a plurality of projection receivers which are complementarily disposed on the facing surfaces of the upper and lower housings.

The support projections may be mounted on the lower housing, and the projection receivers may be mounted on the upper housing.

Each of the support projections may include an inserting part which has a cruciform shape, a leading edge of which is chamfered; and a first support boss which is formed to have a diameter greater than the length of the major axis of the inserting part.

Each of the projection receivers may include a mounting recess into which the inserting part is inserted; and a second support boss comprising the mounting recess formed therein.

The mounting recess may have a depth of approximately 1 mm or less.

When a length of the upper housing is L, the support unit may be disposed at a position closer than a point equal to ½ L to a photosensitive medium. Additionally, the support units may be linearly disposed at a predetermined interval in left, central and right positions of the upper and lower housings.

The support units may further include support ribs extending from the support projections. Each of the support ribs may have an inclined surface.

The outer surfaces of the upper and lower housings may be engaged with each other so that the upper and lower housings may be thermally bonded to each other.

The foregoing and/or other aspects and utilities of the present general inventive concept may also be achieved by providing an image forming apparatus including a photosensitive medium on which an electrostatic latent image is formed; a developing unit, as described above, to develop the electrostatic latent image of the photosensitive medium using toner; a transferring unit to transfer an image developed on the photosensitive medium to a printing medium; a fixing unit to apply heat and pressure onto the printing medium and fix the image; and a discharging unit to discharge the printing medium bearing the image.

The foregoing and/or other aspects and utilities of the present general inventive concept may also be achieved by providing a developing cartridge including a photosensitive medium, a toner container to contain toner to supply the toner to the photosensitive medium, and a waste toner container to contain waste toner removed from the photosensitive medium, the waste toner container including a first wall which is also an exterior wall of the developing cartridge, a second wall opposite to and facing the first wall and at least one support positioned at an interior location of the container extending between the first and second walls.

The foregoing and/or other aspects and utilities of the present general inventive concept may also be achieved by providing a developing cartridge usable with an image forming apparatus, including a photosensitive medium, a toner container to contain toner to supply the toner to the photosensitive medium, and a waste toner container disposed above the toner container and spaced apart from the toner container, and including upper and lower housings to form a space to receive waste toner removed from the photosensitive medium, the lower housing having a first end to contact the upper housing, a second end formed with a cleaning member, and a meddle portion between the first end and the second end to be formed with one or more supports to maintain a distance between the upper and lower housings

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
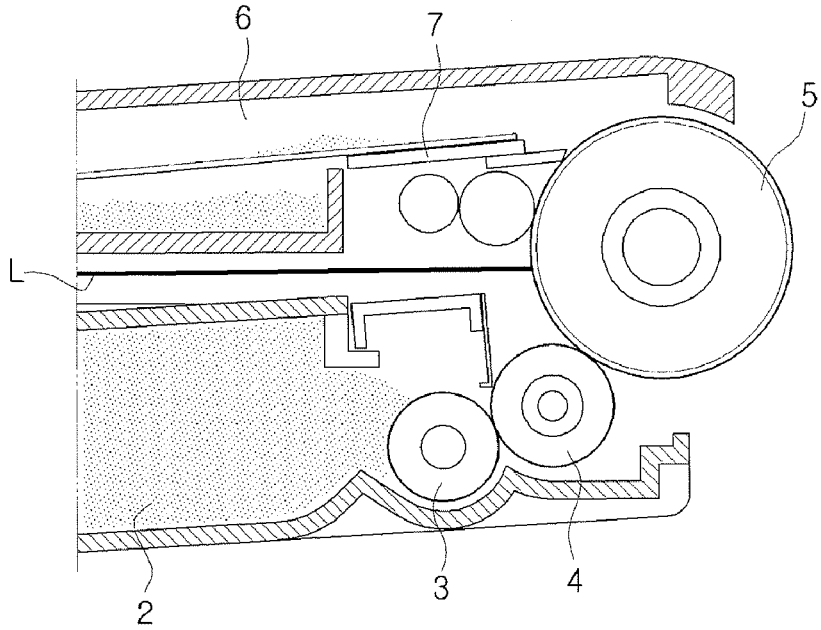
FIG. 1 (PRIOR ART)
FIG. 1 is a sectional view illustrating a portion of a conventional developing unit.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
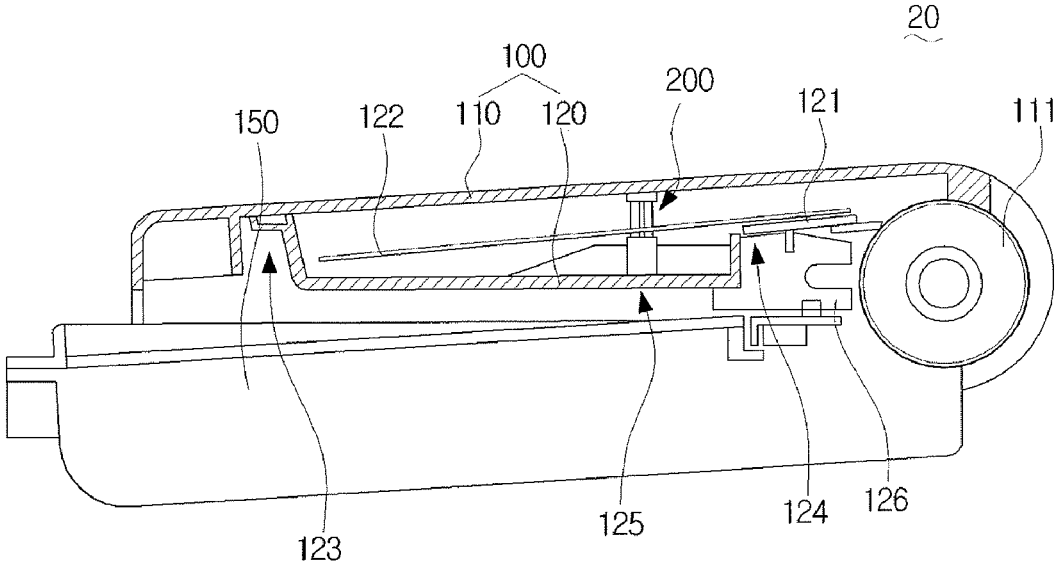
FIG. 2 is a sectional view illustrating a developing unit according to an exemplary embodiment of the present general inventive concept.

Referring to FIG. 2, a developing unit according to an exemplary embodiment of the present general inventive concept includes a waste toner housing 100, a toner housing 150, and a support unit 200.

The waste toner housing 100 includes an upper housing 110 and a lower housing 120. The outer surfaces of the upper and lower housings 110 and 120 may be engaged with each other so that the upper and lower housings 110 and 120 may be thermally bonded to each other. Accordingly, waste toner may be collected in an internal space formed between the upper and lower housings 110 and 120. The upper housing 110 may rotatably support a photosensitive medium 111. A cleaning member 121 to clean a surface of the photosensitive medium 111 may be attached to the lower housing 120. A waste toner transfer member 122 is mounted on a waste toner transfer surface of the cleaning member 121 so as to be able to move from side to side.

Unused toner may be housed in the toner housing 150, and the toner housing 150 may be mounted on a lower part of the waste toner housing 100 and spaced apart from the waste toner housing 100 at a predetermined distance in order not to interfere with a laser beam emitted from a laser scanning unit 25 (referring to FIG. 7), as illustrated in FIG. 2.

The lower housing 120 of the waste toner housing 100 may have one end 123 to contact or be coupled to the upper housing 110, and the other end 124 coupled or formed with the cleaning member 121. The other end 124 of the lower housing 120 may be coupled to or formed with a middle member 126 to support the loser housing 120 with respect to the toner housing 150 and/or support the cleaning member 121 with respect to the lower housing 120. The support unit 200 may be formed on a middle portion 125 between the one end 123 and the other end 124.

As illustrated in FIGS. 3 to 6, the support units 200 may allow connection between the upper and lower housings 110 and 120 and support the upper and lower housings 110 and 120. The support units 200 include a plurality of support projections 210 and a plurality of projection receivers 220 which are complementarily disposed on a surface on which the upper and lower housings 110 and 120 face each other. The support unit 200 may be mounted in the interior of the waste toner housing 100, and may prevent the upper and lower housings 110 and 120 from being deformed by heat or pressure.

Figure 3:
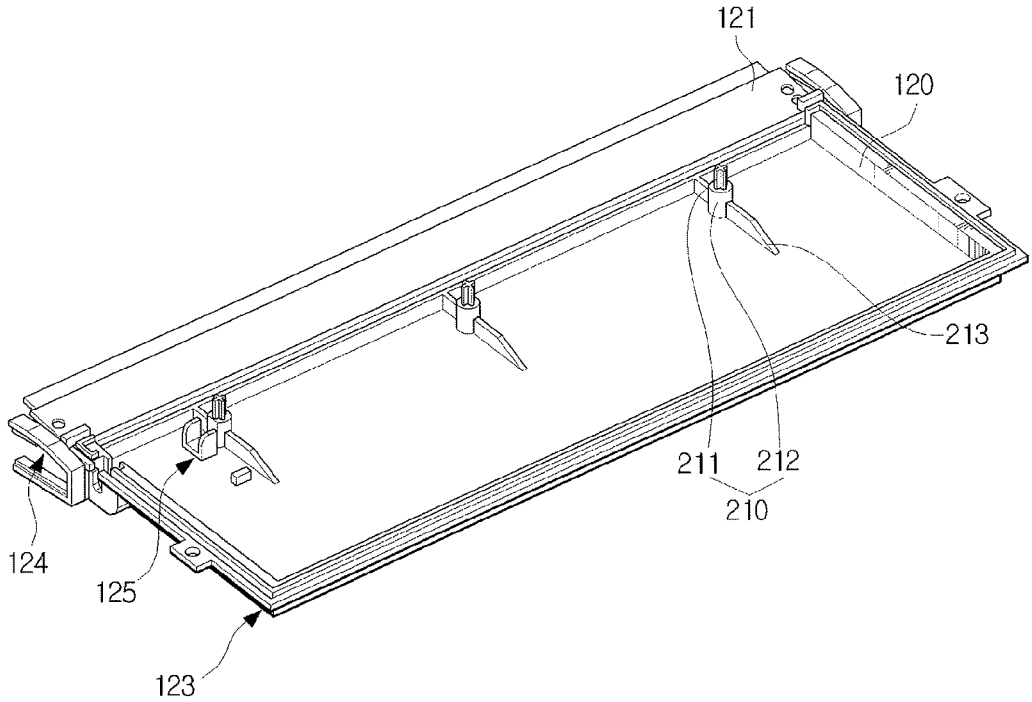
FIG. 3 is a perspective view illustrating a lower housing of a waste toner housing of the developing unit of FIG. 2.
Figure 4:
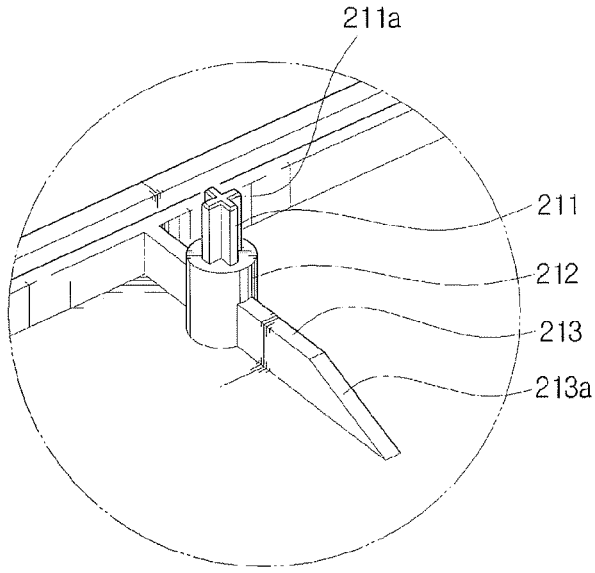
FIG. 4 is a perspective view illustrating the main parts of the lower housing of FIG. 3.
Figure 5:
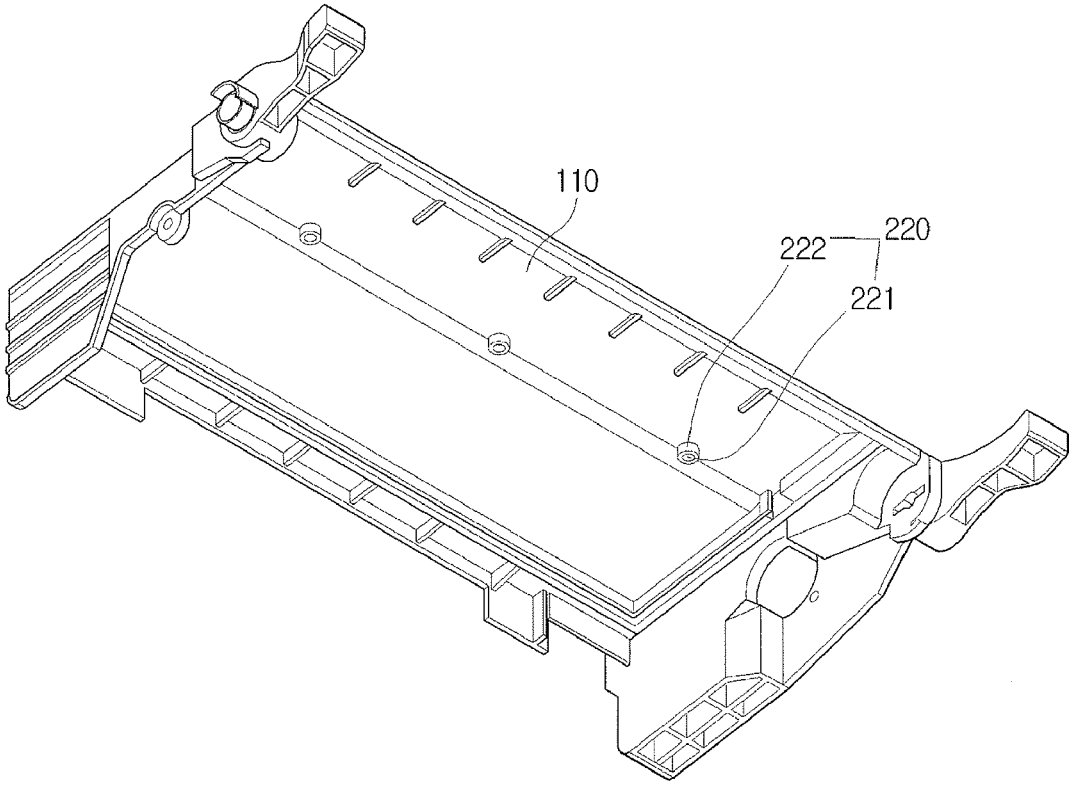
FIG. 5 is a perspective view illustrating an upper housing which is secured to the lower housing of FIG. 3, viewed from beneath.

According to the exemplary embodiment, the support projections 210 may be mounted on the lower housing 120 as illustrated in FIGS. 3 and 4, and the projection receivers 220 may be mounted on the upper housing 110 as illustrated in FIG. 5. However, these mounting locations may be reversed.

Each of the support projections 210 includes an inserting part 211 and a first support boss 212.

Referring to FIG. 4, the inserting part 211 may have a cruciform shape, and a chamfer 211*a* may be formed on a leading edge of the inserting part 211. The first support boss 212 may have a diameter greater than the length of the major axis of the inserting part 211, and may be formed integrally with a support rib 213 having an inclined surface 213*a*. The first support boss 212 may support the waste toner transfer member 122 so that the waste toner transfer member 122 may have a downward inclination.

Each of the projection receivers 220 includes a mounting recess 221 and a second support boss 222, as illustrated in FIG. 5.

The mounting recess 221 may be formed in the second support boss 222, which has a diameter corresponding to the diameter of the first support boss 212, and may have a depth of approximately 1 mm or less. The mounting recess 221 may have an inner diameter equal to the length of the major axis of the inserting part 211 so that the inserting part 211 can be inserted into the mounting recess 221.

One or more support units 200 configured as described above may be mounted in the internal space of the waste toner housing 100 in order to strengthen the structural rigidity of the waste toner housing 100. The walls of the upper and lower housings 110 and 120, which are thermally bonded to each other, may also strengthen the structural rigidity of the waste toner housing 100.

Figure 6:
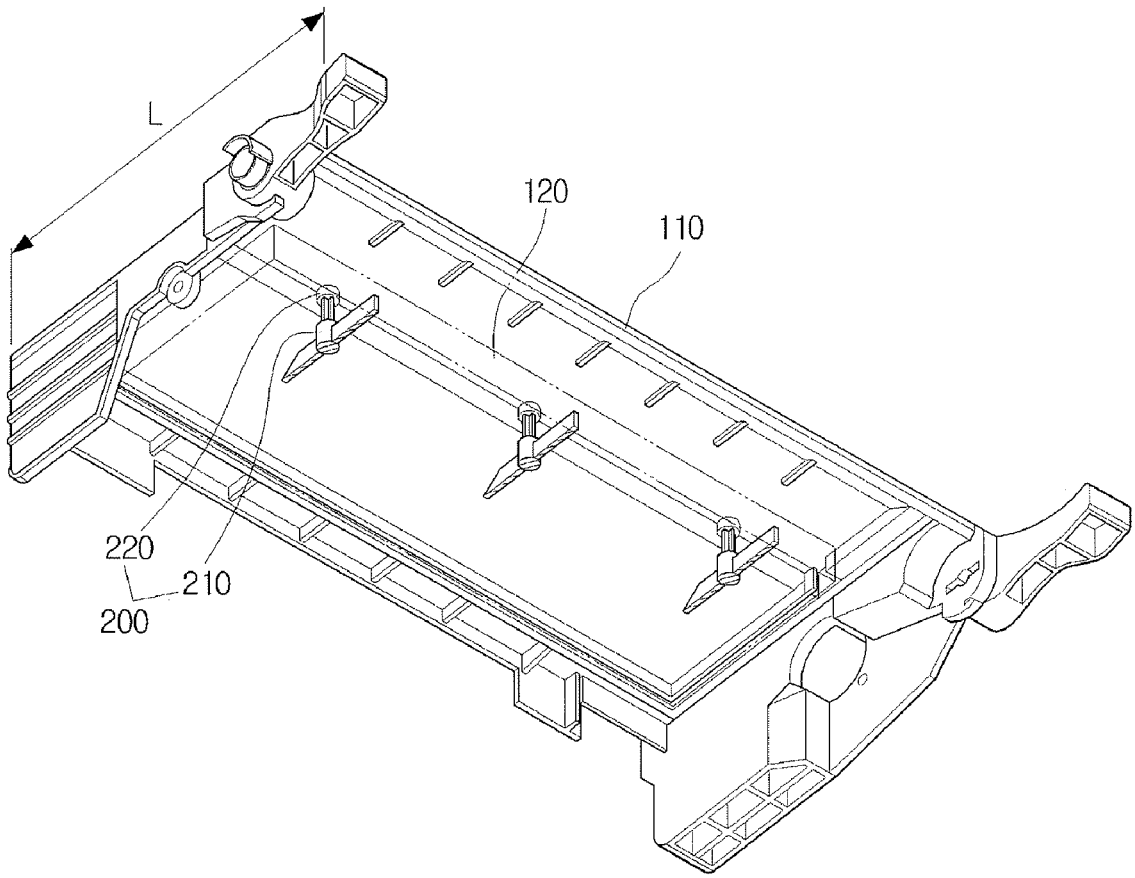
FIG. 6 is a perspective view illustrating the waste toner housing comprising the upper and lower housings which are secured, viewed from beneath.

Referring to FIG. 6, when a length of the upper housing 110 is L, the support unit 200 may be disposed at a position closer than a point equal to ½ L to the photosensitive medium 111. This is because the structural rigidity of the upper housing 110 is weakened by the opening formed at a position facing the photosensitive medium 111.

As illustrated in FIGS. 3 to 6, the support units 200 may be linearly disposed at a predetermined interval in left, central and right positions of the upper and lower housings 110 and 120. Accordingly, the support unit 200 configured as described above may prevent deformation, for example sag or skew of the waste toner housing 100, and may also guide the installation and the movement of the waste toner transfer member 122 which is mounted so as to be able to move from side to side.

Hereinafter, an operation of an image forming apparatus including the developing unit according to the exemplary embodiment of the present general inventive concept will be described with reference to FIG. 7.

Figure 7:
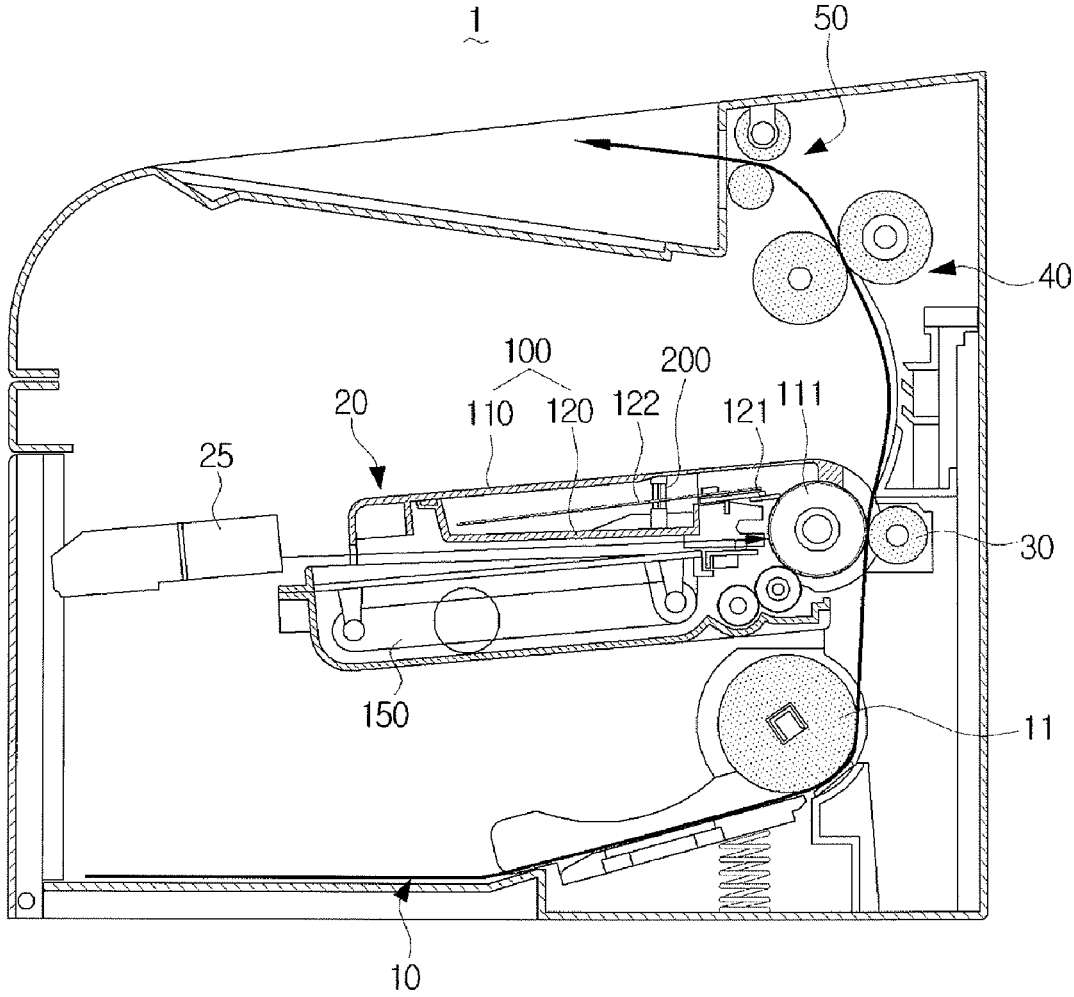
FIG. 7 is a view illustrating an image forming apparatus having a developing unit according to an exemplary embodiment of the present general inventive concept.

In FIG. 7, an image forming apparatus 1 according to the exemplary embodiment of the present general inventive concept includes a feeding unit 10, a developing unit 20, a transferring unit 30, a fixing unit 40 and a discharging unit 50.

When printing starts, sheets of paper housed in the feeding unit 10 may be transferred to the developing unit 20 by a pick-up unit 11. A laser scanning unit 25 may create print image information using a laser beam, and the laser beam may be directed on the photosensitive medium 111 so that an electrostatic latent image can be formed on a surface of the photosensitive medium 111. The developing unit 20 may develop toner on the electrostatic latent image to form a toner image, and the photosensitive medium 111 may transfer the toner image onto the sheet of paper while rotating in tight contact with the transferring unit 30. Heat and pressure may be applied from the fixing unit 40 to the sheet of paper onto which the toner image is transferred, and then the toner image may be fixed onto the surface of the sheet of paper, to thereby complete printing. Additionally, the sheet of paper on which the toner image is fixed may be discharged to the outside of the image forming apparatus 1 by the discharging unit 50.

In order to reduce the volume of the developing unit, the waste toner housing 100 may be spaced apart from the toner housing 150, which is disposed below the waste toner housing 100, and the internal space between the waste toner housing 100 and the toner housing 150 may be used as a light path for the laser beam in the developing unit 20 according to the exemplary embodiment. Therefore, the deformation of the waste toner housing 100 by heat or pressure may cause interference with the light path of the laser beam.

However, in the waste toner housing 100 according to the exemplary embodiment, the wall surfaces of the upper and lower housings 110 and 120 which are meshed with each other may be thermally bonded to each other, and the structural rigidity of the upper and lower housings 110 and 120 may be strengthened by at least one support unit 200 in the internal space. Accordingly, even if heat capable of causing the upper and lower housings 110 and 120 to sag, become skewed or otherwise deformed is applied to either the upper housing 110 or the lower housing 120, deformation of the waste toner housing 100 is minimized. Therefore, even if the light path formed between the waste toner housing 100 and the toner housing 150 through which the laser beam may pass is narrow, there is no problem of interference.

Figure 8:
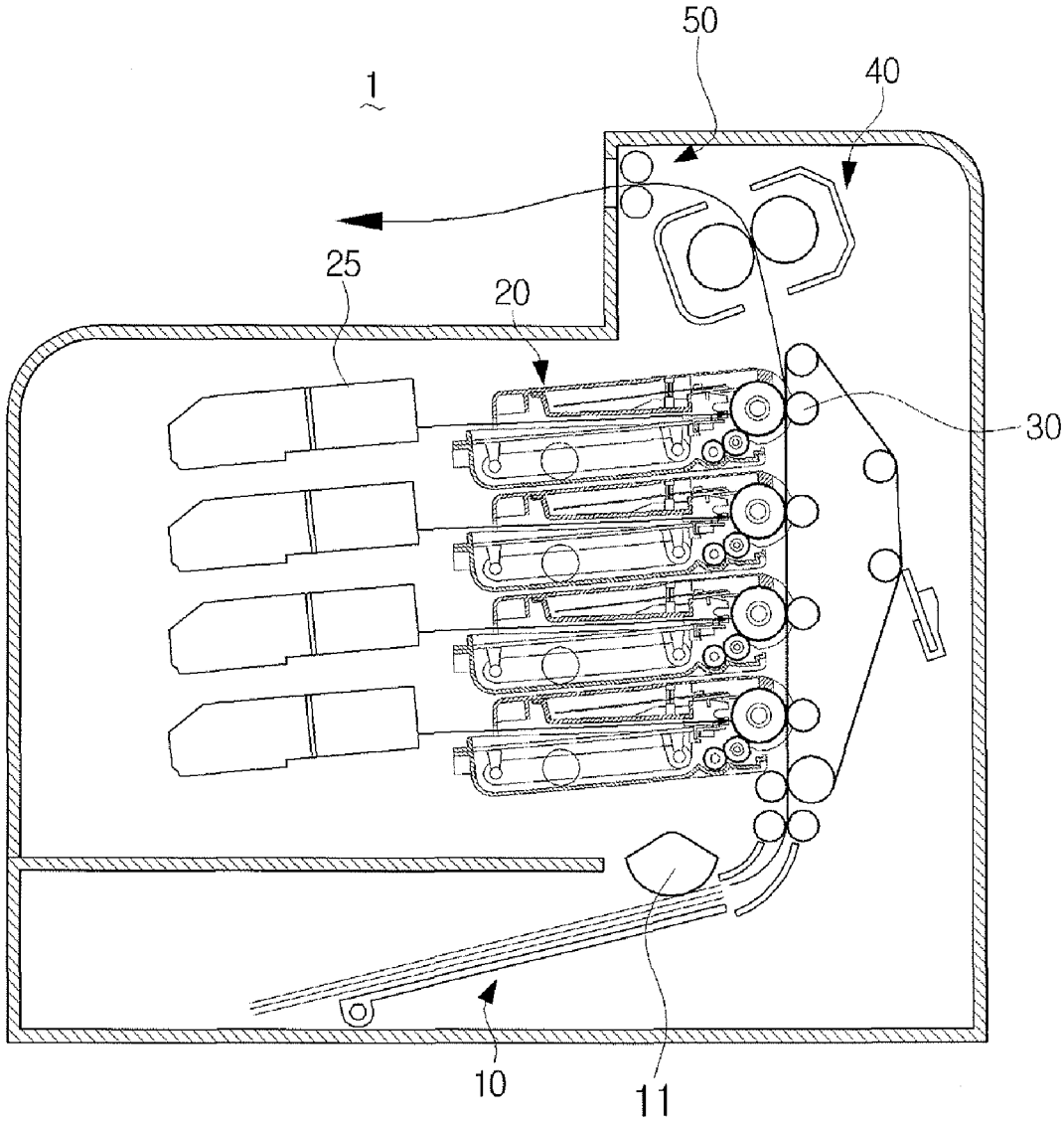
FIG. 8 is a view illustrating a color image forming apparatus having a plurality of developing units according to an exemplary embodiment of the general inventive concept.

As illustrated in FIG. 8, the developing unit 20 including a waste toner collecting device according to an exemplary embodiment is applicable to a color image forming apparatus. In this example, four developing units 20 containing yellow, magenta, cyan and black toners respectively are mounted in a stack formation as illustrated in FIG. 8.

In the stack of developing units 20, a developing unit 20 may collides with adjacent developing units 20 when the developing unit 20 is attached or detected, thereby inadvertently exerting force to the waste toner housing 100. However, any force exerted on the upper housing 110, and any force from vertically shaking (e.g., when attaching or detaching the developing unit 20) is resisted by the lower housing 120 and at least one support unit 200. Accordingly, it is possible to prevent the positions of the cleaning member 121 and various film components for sealing from being changed, which may have been caused if the upper housing 110 had been deformed, and thus it is possible also to prevent waste toner from flowing back due to an air leak.

According to the exemplary embodiments described above, it is possible to prevent the waste toner housing from being deformed by heat and pressure, and thus white lines on images, flowback of waste toner and insufficient cleaning, and interference with a light path due to the deformation of the waste toner housing, can be reduced.

In addition, tolerance can be greatly reduced as a result of resolving the problem of deformation of the waste toner housing, so a developing unit having a smaller size can be provided.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing unit of an image forming apparatus, comprising:

a waste toner housing which comprises an upper housing and a lower housing which face each other, in which a photosensitive medium and a cleaning member to clean a surface of the photosensitive medium are installed, and which collects waste toner removed by the cleaning member in a space formed by the upper housing and the lower housing;

a toner housing which is spaced apart from an external wall of the lower housing of the waste toner housing at a predetermined distance, which is disposed so that a laser beam passes through a space between the toner housing and the waste toner housing, which contains toner, and which comprises a developing roller to supply the toner on the surface of the photosensitive medium; and at least one support unit which is formed in the lower housing of the waste toner housing to contact an upper housing of the waste toner housing so as to prevent interference with a light path of the laser beam caused due to deformation of the lower housing by preventing deformation of the lower housing.

2. The developing unit according to claim 1, wherein the support unit comprises a plurality of supports, including a plurality of support projections and a plurality of projection receivers which are complementarily disposed on the facing surfaces of the upper and lower housings.

3. The developing unit according to claim 2, wherein the support projections are disposed on the upper housing, and the projection receivers are disposed on the lower housing.

4. The developing unit according to claim 3, wherein each of the support projections comprises:

an inserting part which has a cruciform shape, a leading edge of which is chamfered; and a first support boss having a width greater than a length of a major axis of the inserting part.

5. The developing unit according to claim 4, wherein each of the projection receivers comprises:

a mounting recess into which the inserting part is inserted; and a second support boss comprising the mounting recess formed therein.

6. The developing unit according to claim 5, wherein the mounting recess has a depth of approximately 1 mm or less.

7. The developing unit according to claim 5, wherein, when a length of the upper housing taken in a direction perpendicular to an axis of a photosensitive medium is L, the plurality of supports are disposed at a position closer than a distance of ½ L to the photosensitive medium.

8. The developing unit according to claim 7, wherein the plurality of supports are evenly spaced along a line in left, central and right positions of the upper and lower housings.

9. The developing unit according to claim 8, wherein the plurality of supports further comprise support ribs extending from the support projections.

10. The developing unit according to claim 9, wherein each of the support ribs has an inclined surface.

11. The developing unit according to claim 10, wherein the outer surfaces of the upper and lower housings are engaged with each other so that the upper and lower housings are thermally bonded to each other.

12. The developing unit according to claim 1, wherein the toner housing is disposed under the waste toner housing.

13. An image forming apparatus comprising a feeding unit, a transmitting unit to transmit recording medium from the feeding unit, a laser scanning unit, a developing unit, a transferring unit, a fixing unit and a discharging unit, the developing unit comprising:

a waste toner housing which comprises an upper housing and a lower housing which face each other, in which a photosensitive medium and a cleaning member to clean a surface of the photosensitive medium are installed, and which collects waste toner removed by the cleaning member in a space formed by the upper housing and the lower housing;

a toner housing which is spaced apart from an external wall of the lower housing of the waste toner housing at a predetermined distance, which is disposed so that a laser beam passes through a space between the toner housing and the waste toner housing, which contains toner, and which comprises a developing roller to supply the toner on the surface of the photosensitive medium; and at least one support unit which is formed in the lower housing of the waste toner housing to contact an upper housing of the waste toner housing so as to prevent interference with a light path of the laser beam caused due to deformation of the lower housing by preventing deformation of the lower housing.

14. The image forming apparatus according to claim 13, wherein the support unit comprises a plurality of supports, including a plurality of support projections and a plurality of projection receivers which are complementarily disposed on the facing surfaces of the upper and lower housings.

15. The image forming apparatus according to claim 14, wherein the support projections are disposed on the upper housing, and the projection receivers are disposed on the lower housing.

16. The image forming apparatus according to claim 15, wherein each of the support projections comprises:

an inserting part which has a cruciform shape, a leading edge of which is chamfered; and a first support boss having a width greater than a length of a major axis of the inserting part.

17. The image forming apparatus according to claim 16, wherein each of the projection receivers comprises:

a mounting recess into which the inserting part is inserted; and a second support boss comprising the mounting recess formed therein.

18. The image forming apparatus according to claim 17, wherein the mounting recess has a depth of approximately 1 mm or less.

19. The image forming apparatus according to claim 17, wherein, when a length of the upper housing taken in a direction perpendicular to an axis of a photosensitive medium is L, the plurality of supports are disposed at a position closer than a distance of ½ L to the photosensitive medium.

20. The image forming apparatus according to claim 19, wherein the plurality of supports are evenly spaced along a line in left, central and right positions of the upper and lower housings.

* * * * *